US007032354B2

(12) United States Patent
Hansort

(10) Patent No.: US 7,032,354 B2
(45) Date of Patent: Apr. 25, 2006

(54) SANDWICH ERECTION LIFT ANCHOR WITH WELDING PLATE ASSEMBLY

(75) Inventor: Rens Hansort, Naperville, IL (US)

(73) Assignee: Universal Form Clamp Co., Inc., Bellwood, IL (US)

( * ) Notice: Subject to any disclaimer, the term of this patent is extended or adjusted under 35 U.S.C. 154(b) by 0 days.

(21) Appl. No.: 10/324,293

(22) Filed: Dec. 19, 2002

(65) Prior Publication Data

US 2003/0110715 A1 Jun. 19, 2003

Related U.S. Application Data

(60) Provisional application No. 60/342,017, filed on Dec. 19, 2001.

(51) Int. Cl.
*E02D 35/00* (2006.01)

(52) U.S. Cl. ..... 52/125.3; 52/125.4; 52/125.5; 294/89; 294/82.1

(58) Field of Classification Search ..... 52/125.4, 52/125.5, 576, 125.6, 125.2, 125.3, 698, 52/699, 707, 708, 125.1, 701, 704; 294/89, 294/82.1, 81.53, 82.24, 93, 82.31; 248/499
See application file for complete search history.

(56) References Cited

U.S. PATENT DOCUMENTS

| | | | | |
|---|---|---|---|---|
| 958,978 | A | 5/1910 | Spencer | |
| 1,056,955 | A | 3/1913 | Stamm | |
| 1,123,107 | A | 12/1914 | Darr | |
| 1,970,860 | A | 8/1934 | Lowell | |
| 1,984,211 | A | 12/1934 | Haase | |
| 2,163,446 | A * | 6/1939 | Heckman | 52/709 |
| 2,772,560 | A | 12/1956 | Neptune | |
| 2,886,370 | A | 5/1959 | Liebert | |
| 2,984,195 | A | 5/1961 | Duncan | |
| 3,297,293 | A | 1/1967 | Andrews et al. | |
| 3,499,676 | A | 3/1970 | Haeussler | |
| 3,652,118 | A | 3/1972 | Goldberg | |
| 3,861,106 | A | 1/1975 | Erhart | |
| 3,883,170 | A | 5/1975 | Fricker et al. | |
| 3,998,487 | A | 12/1976 | Biondo | |
| 4,000,591 | A | 1/1977 | Courtois | |
| 4,087,947 | A | 5/1978 | Turner | |

(Continued)

FOREIGN PATENT DOCUMENTS

DE 1 684 278 6/1967

(Continued)

OTHER PUBLICATIONS

Dayton Superior, Precast-Prestressed Concrete Handbook, 1986, 6 pages.
Dayton Superior, Tilt-up construction Handbook, 1990, 10 pages.

*Primary Examiner*—Kimberly Wood
(74) *Attorney, Agent, or Firm*—Jeffrey D. Peterson; Michael Best & Friedrich LLP

(57) ABSTRACT

The present invention relates towards an erection lift anchor with welding plate assembly for embedment in a concrete member, such as a precast or tilt-up wall. The erection anchor of the present invention allows for concrete members, such as walls, to be positioned by the use of standard lifting equipment (cranes with cable attachments, etc.) by connecting lifting attachments to the erection lift anchor which is embedded in a concrete member. The present invention also allows for concrete members to be connected together via the erection lift anchor whereby the welding plate of one erection lift anchor embedded in a first concrete member is welded to the welding plate of another erection lift member embedded in a second concrete member.

21 Claims, 8 Drawing Sheets

U.S. PATENT DOCUMENTS

| | | | |
|---|---|---|---|
| 4,173,367 | A | 11/1979 | Haeussler |
| 4,173,856 | A | 11/1979 | Fricker |
| 4,262,951 | A | 4/1981 | Hoyer |
| 4,290,638 | A | 9/1981 | Manning |
| 4,296,909 | A | 10/1981 | Haeussler |
| 4,329,826 | A | 5/1982 | Flogaus et al. |
| 4,367,892 | A | 1/1983 | Holt |
| 4,368,914 | A | 1/1983 | Truitt et al. |
| 4,383,674 | A | 5/1983 | Fricker |
| 4,386,486 | A | 6/1983 | Holt et al. |
| 4,398,762 | A | 8/1983 | Haeussler et al. |
| D272,517 | S | 2/1984 | Koehn |
| 4,437,642 | A | 3/1984 | Holt |
| 4,466,569 | A | 8/1984 | Taylor |
| 4,538,850 | A | 9/1985 | De Vito |
| 4,580,378 | A | 4/1986 | Kelly et al. |
| 4,603,522 | A | 8/1986 | Johnson |
| 4,615,554 | A | 10/1986 | Schilla et al. |
| 4,627,198 | A | 12/1986 | Francies, III |
| 4,634,326 | A | 1/1987 | Fischer |
| 4,655,015 | A | 4/1987 | Hoyer |
| 4,671,554 | A | 6/1987 | Lancelot |
| 4,702,045 | A | 10/1987 | Fricker |
| 4,703,595 | A | 11/1987 | Zipf et al. |
| 4,713,856 | A | 12/1987 | Clausen |
| 4,726,562 | A | 2/1988 | Courtois et al. |
| 4,769,960 | A | 9/1988 | Zipf et al. |
| 4,807,843 | A | 2/1989 | Courtois et al. |
| 4,821,994 | A | 4/1989 | Fricker |
| 4,869,042 | A | 9/1989 | Fricker |
| 4,930,269 | A | 6/1990 | Kelly et al. |
| 4,947,613 | A | 8/1990 | Fricker |
| 5,004,208 | A | 4/1991 | Domizio |
| 5,014,473 | A | 5/1991 | Kelly et al. |
| 5,042,219 | A | 8/1991 | Fricker |
| 5,094,047 | A | 3/1992 | Kelly et al. |
| 5,155,954 | A | 10/1992 | Roire |
| 5,177,928 | A | 1/1993 | Fricker |
| 5,226,265 | A | 7/1993 | Kelly et al. |
| D344,836 | S | 3/1994 | Huffman |
| 5,396,743 | A | 3/1995 | Bellette |
| 5,431,368 | A | 7/1995 | Wilde |
| 5,469,675 | A | 11/1995 | Arteon |
| 5,535,979 | A | 7/1996 | Ellis-Callow |
| D374,394 | S | 10/1996 | Lynch et al. |
| 5,588,263 | A | 12/1996 | Kelly et al. |
| 5,596,846 | A | 1/1997 | Kelly |
| 5,651,911 | A | 7/1997 | Pennypacker |
| D389,251 | S | 1/1998 | Kelly |
| D392,752 | S | 3/1998 | Kelly et al. |
| 5,809,703 | A | 9/1998 | Kelly |
| 5,852,907 | A | 12/1998 | Tobin et al. |
| 5,857,296 | A | 1/1999 | Niday et al. |
| 5,884,438 | A | 3/1999 | Westhoff et al. |
| 5,987,830 | A | 11/1999 | Worley |
| D422,894 | S | 4/2000 | Kubica |
| 6,082,700 | A | 7/2000 | Lancelot, III et al. |
| 6,092,849 | A * | 7/2000 | Zambelli et al. ..... 294/89 |
| 6,119,431 | A | 9/2000 | Wakai |
| 6,131,976 | A | 10/2000 | Silva |
| D437,063 | S | 1/2001 | Lancelot, III et al. |
| D438,649 | S | 3/2001 | Lancelot et al. |
| D438,991 | S | 3/2001 | Lancelot, III et al. |
| 6,233,883 | B1 | 5/2001 | Artdon |
| 6,260,900 | B1 | 7/2001 | Scott |
| 6,341,452 | B1 | 1/2002 | Bollinghaus |
| 6,343,444 | B1 | 2/2002 | Minami |
| 6,460,824 | B1 | 10/2002 | Lancelot, III et al. |
| 6,550,834 | B1 | 4/2003 | Fromelius |
| 6,581,996 | B1 | 6/2003 | Fromelius |
| 6,647,674 | B1 | 11/2003 | Lancelot et al. |
| 6,694,680 | B1 | 2/2004 | Zambelli et al. |
| 6,729,079 | B1 | 5/2004 | Francies, III et al. |
| 2003/0213206 | A1 | 11/2003 | Hansort |

FOREIGN PATENT DOCUMENTS

| | | |
|---|---|---|
| DE | 1 800 807 | 10/1968 |
| DE | 2 223 519 | 5/1972 |
| DE | 2 610 195 | 3/1976 |
| DE | 3 515 894 | 11/1986 |
| EP | 0 568 934 A2 | 4/1993 |
| EP | 634531 A1 * | 1/1995 |
| FR | 2 586 442 | 8/1985 |
| GB | 408235 | 9/1932 |
| IT | 269410 | 11/1929 |

* cited by examiner

SANDWICH ERECTION LIFT ANCHOR WITH WELDING PLATE ASSEMBLY

This application claims the benefit of the filing date of U.S. Provisional Application No. 60/342,017, filed Dec. 19, 2001 which is incorporated herein by reference.

The present invention relates towards an erection lift anchor assembly for embedment in a concrete member, such as a precast or tilt-up wall. The erection anchor of the present invention allows for concrete members, such as walls, to be positioned by the use of standard lifting equipment (cranes with cable attachments, etc.) by connecting lifting attachments to the erection lift anchor which is embedded in a concrete member. The present invention also allows for concrete members to be connected together via the erection lift anchor.

SUMMARY OF INVENTION

The present invention is directed towards an erection lift anchor. The erection lift anchor of the present invention comprises an anchor plate and a welding plate.

The anchor plate has a top, a bottom, at least one lifting attachment aperture, and at least one reinforcement bar aperture. A first channel, a second channel and a platform section are also positioned on the top of the anchor. The platform section is positioned lower than the top of the anchor plate. The anchor also contains a downwardly projecting foot. The foot comprises a first protruding section, a second protruding section, a first upwardly projecting face, a second upwardly projecting face, and a foot platform. The foot platform is positioned lower than the bottom of the anchor plate.

The welding plate has a top face, a bottom face, and an access aperture. The bottom face of the welding plate is attached to the top of the anchor plate.

The present invention also provides an erection lift anchor kit comprising an erection lift anchor and a void former.

The erection lift anchor comprises an anchor plate and a welding plate. The anchor plate has a top, a bottom, at least one lifting attachment aperture, and at least one reinforcement bar aperture. A first channel, a second channel and a platform section are also positioned on the top of the anchor. The platform section is positioned lower than the top of the anchor plate. The anchor also contains a downwardly projecting foot. The foot comprises a first protruding section, a second protruding section, a first upwardly projecting face, a second upwardly projecting face, and a foot platform. The foot platform is positioned lower than the bottom of the anchor plate.

The welding plate has a top face, a bottom face, and an access aperture. The bottom face of the welding plate is attached to the top of the anchor plate.

The void former comprises a top face, bottom face and an anchor plate channel. The bottom face of the void former can be arcuate in shape. The void former is designed to be received by the access aperture of the erection lift anchor. The void former is positioned onto the erection lift anchor by moving the bottom face of the former through the access aperture of the erection lift anchor, so that the anchor plate channel of the void former receives the anchor plate of the erection lift anchor. The depth of the former is such that when the former is positioned onto the erection lift anchor so that the top face of the void former and the top face of the welding plate are flush, the void former covers the lifting attachment aperture of the erection lift anchor. When the void former is positioned onto the erection lift anchor in such a manner, it provides a void former/anchor system.

The present invention also provides a method of utilizing erection lift anchors to secure concrete members, such as walls, to each other. The method of attaching concrete members to each other first comprises positioning a void former onto an erection lift anchor to provide a void former/anchor system as described above. At least two void former/anchor systems are need to connect two concrete members (one for each member). A first void former/anchor system is embedded in a first concrete member, so that the top face of the welding plate of the first void former/anchor system is flush with the outer face of the first concrete member. A second void former/anchor system is embedded in a second concrete member, so that the top face of the welding plate of the second void former/anchor system is flush with the outer face of the second concrete member. The void formers of the first and second void former/anchor systems are then removed from the first and second erection lift anchors, after the erection lift anchor systems are embedded in concrete, so that the lifting attachment apertures of the first and second erection lift anchors are no longer covered. The first and second concrete members are then secured to each other by welding the welding plate of the first erection lift anchor to the welding plate of the second erection lift anchor.

Other features and advantages of the invention will become apparent to those skilled in the art upon review of the following detailed description and drawings.

Figure 1:
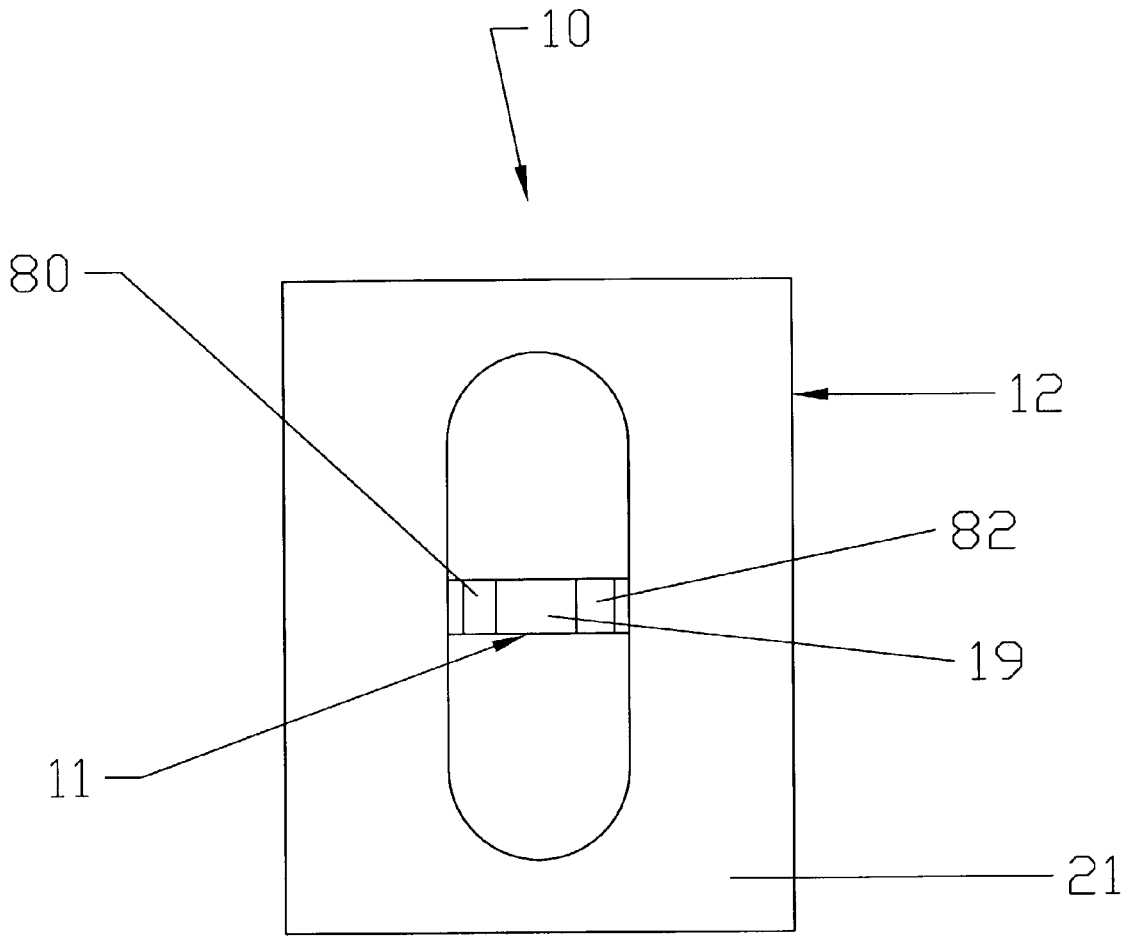
FIG. 1 shows the top side of an erection lift anchor of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE INVENTION

Figure 3:
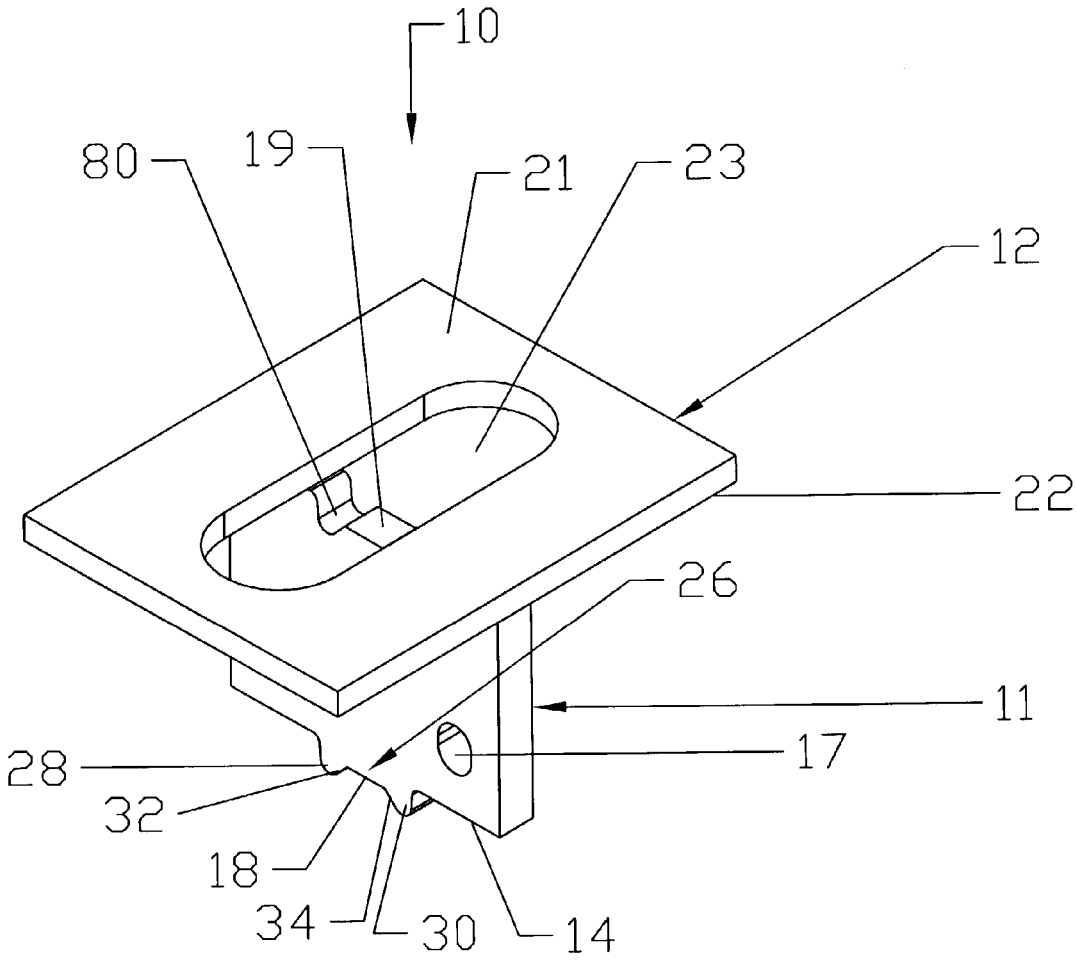
FIG. 3 shows a perspective view of an erection lift anchor of the present invention.
Figure 4:
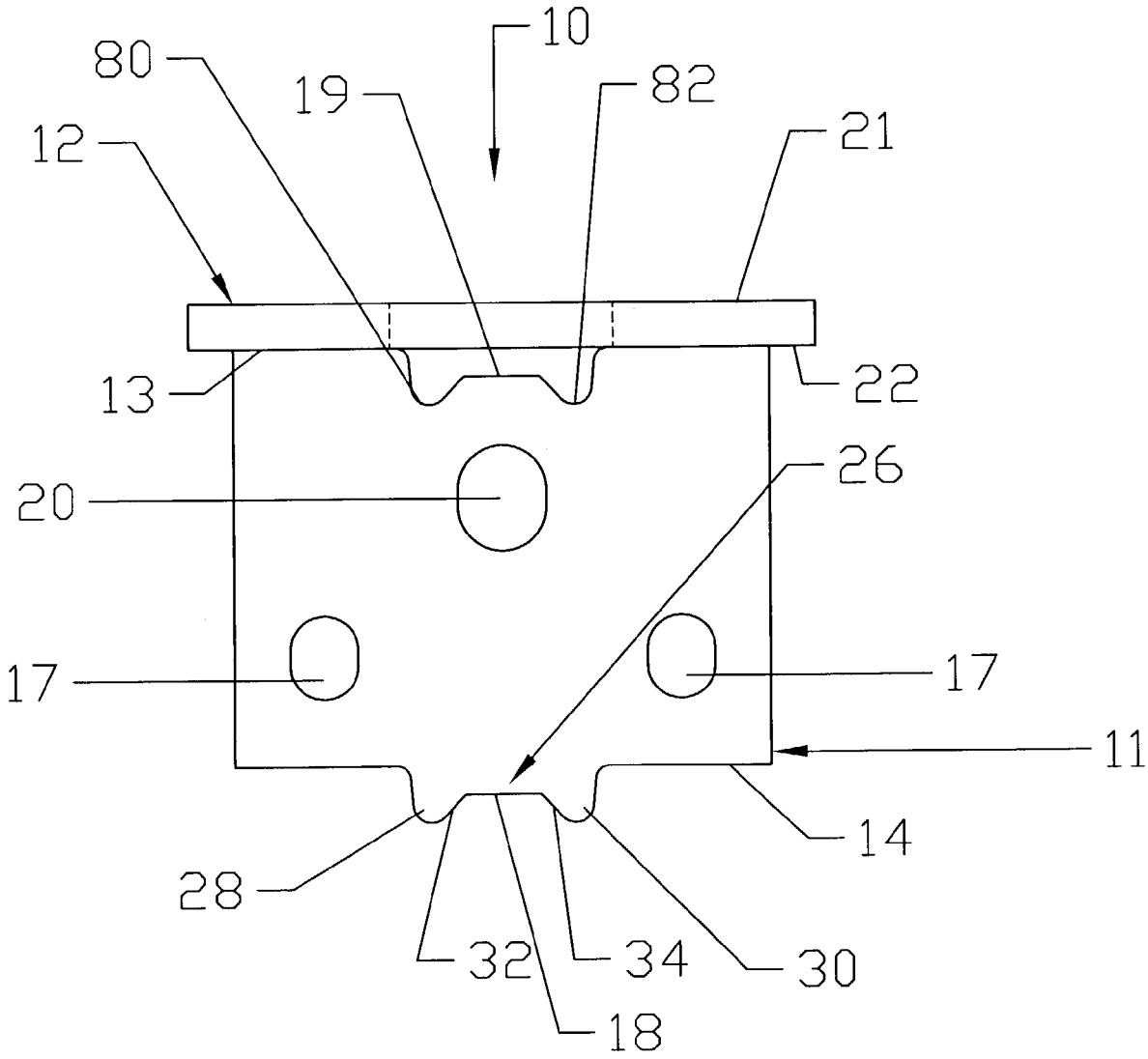
FIG. 4 shows a side view of an erection lift anchor of the present invention.

The erection lift anchor 10 of the present invention is shown in detail in FIGS. 1, 3 and 4. The erection lift anchor 10 is suitably constructed out of a durable metal such as steel. The erection lift anchor 10 of the present invention comprises an anchor plate 11 and a welding plate 12. The anchor plate 11 has a top 13 face, a bottom 14, reinforcement bar apertures 17, and a lifting attachment aperture 20. The top 13 face of the anchor plate 11 also contains a first channel 80 adjacent to a platform section 19 which is in turn adjacent to a second channel 82. The platform section 19 is suitably positioned lower than that of the top 13 of the anchor plate 11. The platform section 19, along with the lifting attachment aperture, is suitably designed to allow for the secure attachment of a lifting mechanism for moving and positioning a concrete form in which the erection lift anchor 10 is embedded. The anchor plate 11 also contains a downwardly projecting foot 26. The foot 26 comprises a first protruding section 28, which is adjacent to a first upwardly projecting face 32, which is adjacent to a foot platform 18, which is adjacent to a second upwardly projecting face 34, which in turn is adjacent to a second protruding section 30. The foot section 26 of the erection lift anchor 10 is suitably designed to rest on any reinforcement bars which are laterally positioned within a concrete form with respect to the anchor plate 11. The foot section 26 is also designed to allow for the positioning of insulation within a concrete form.

The welding plate 12 of the erection lift anchor 10 comprises a top face 21, a bottom face 22, and an access aperture 23. The access aperture 23 is suitably oval in shape and extends perpendicular in direction to the positioning of the anchor plate 11. The bottom face 22 of the welding plate 12 is attached to the top 13 face of the anchor plate. The two plates are suitably connected to each other via a number of welds.

Figure 7:
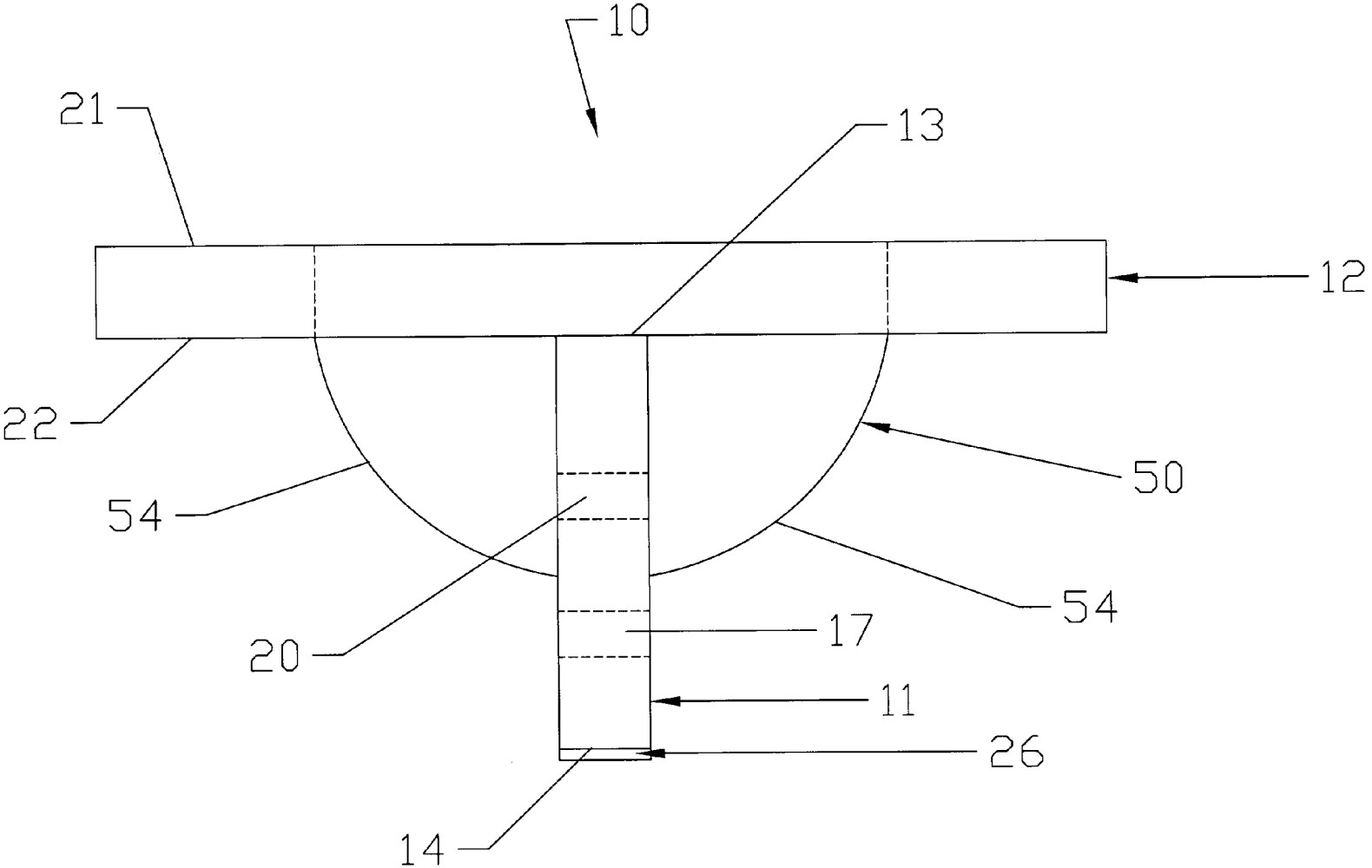
FIG. 7 shows a side view of a void former/anchor system of the present invention.
Figure 8:
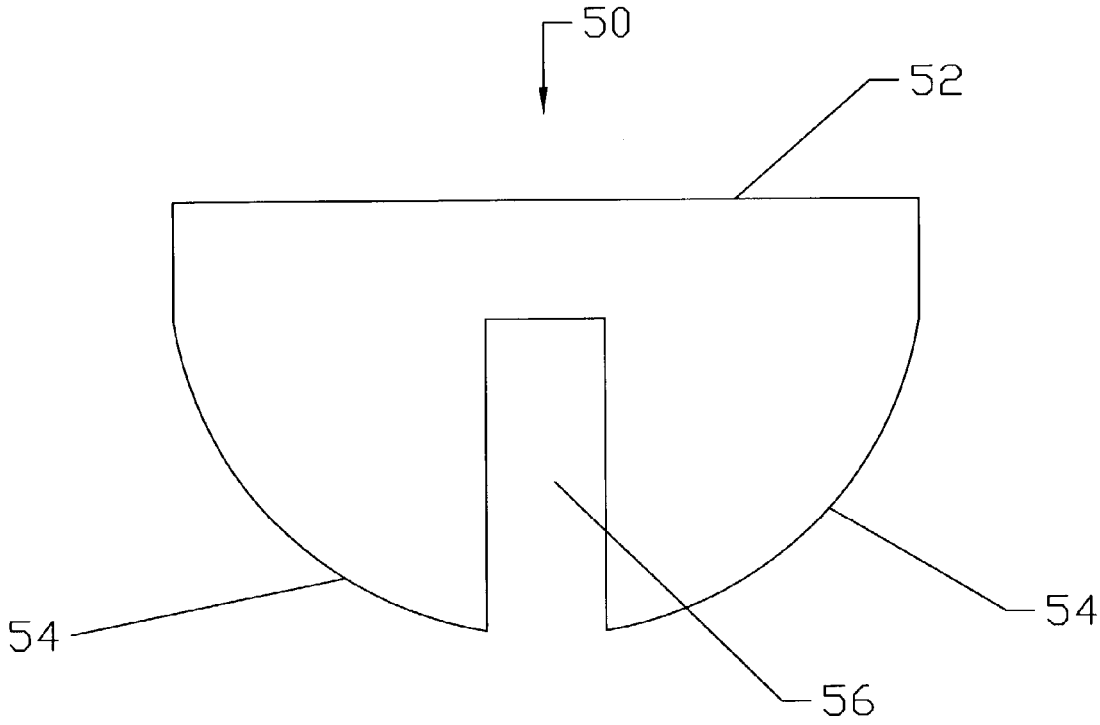
FIG. 8 shows a side view of a void former of the present invention.

The present invention also embodies an erection lift anchor kit comprising an erection lift anchor 10 and a void former 50. The void former 50 and erection lift anchor 10 can be positioned together to form a void former/anchor system. The void former 50 is shown in detail in FIG. 8., and the void former/anchor system is shown in detail in FIG. 2 and FIG. 7.

The void former 50 comprises top face 52, an arcuate bottom face 54 and an anchor plate channel 56. The void former 50 is suitably crafted from a durable and flexible material such as rubber. The void former 50 is designed to be received by the access aperture 23 of the erection lift anchor 10. The void former 50 is positioned onto the erection lift anchor 10 by moving the bottom face 54 of the void former 50 through the access aperture 23 of the erection lift anchor 10 so that the anchor plate channel 56 of the void former 50, receives the anchor plate 11 of the erection lift anchor 10. The depth of the void former 50 is such that than when former 50 is positioned onto the erection lift anchor 10 so that the top face 52 of the void former 50 and the top face 21 of the welding plate 12 are flush, the void former 50 covers the lifting attachment aperture 20 of the erection lift anchor 10.

Figure 2:
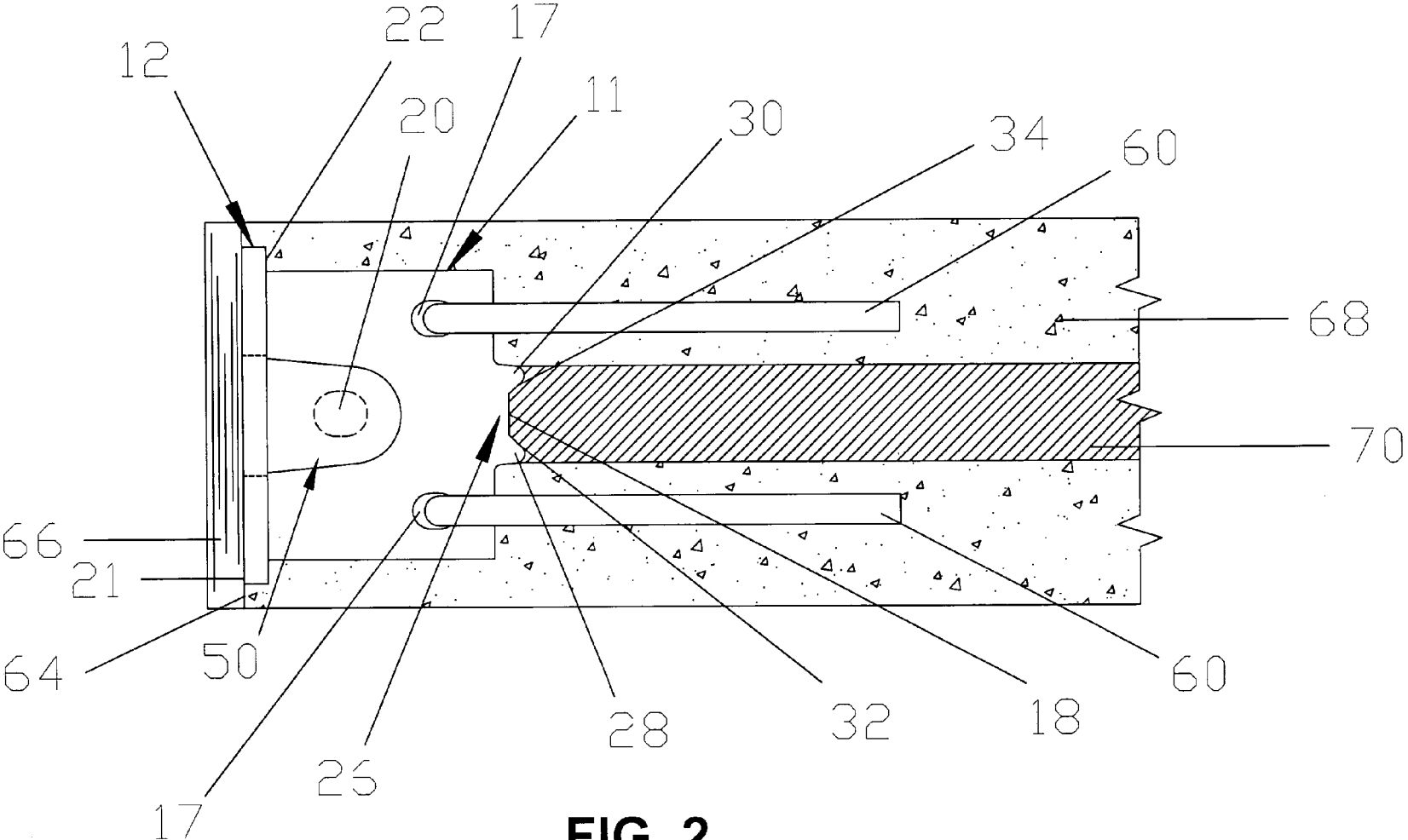
FIG. 2 shows a partial cut away side view of a void former/anchor system of the present invention embedded in a concrete form.
Figure 5:
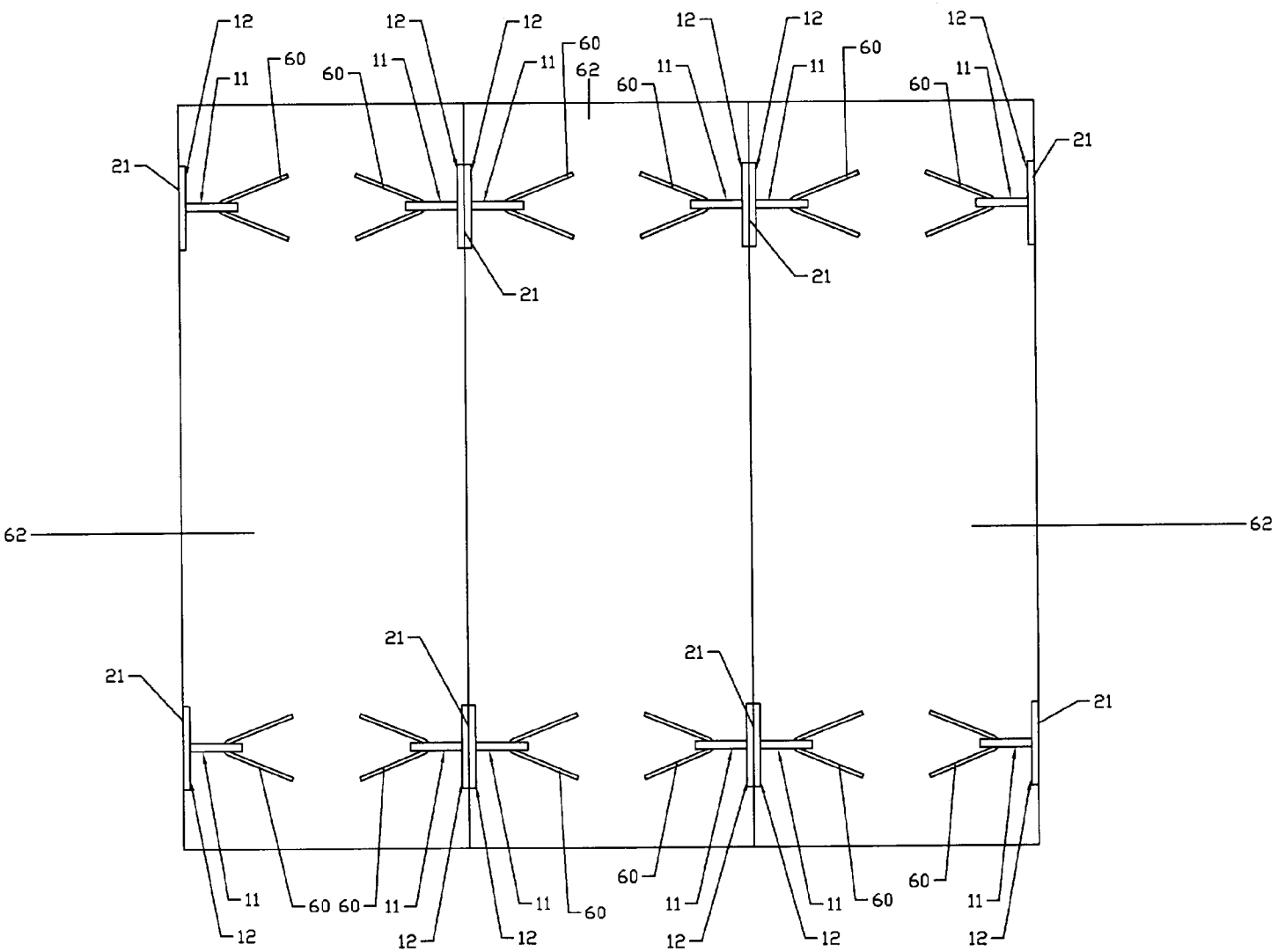
FIG. 5 shows a cutaway front view of concrete wall sections welded together via an erection lift anchors of the present invention.
Figure 6:
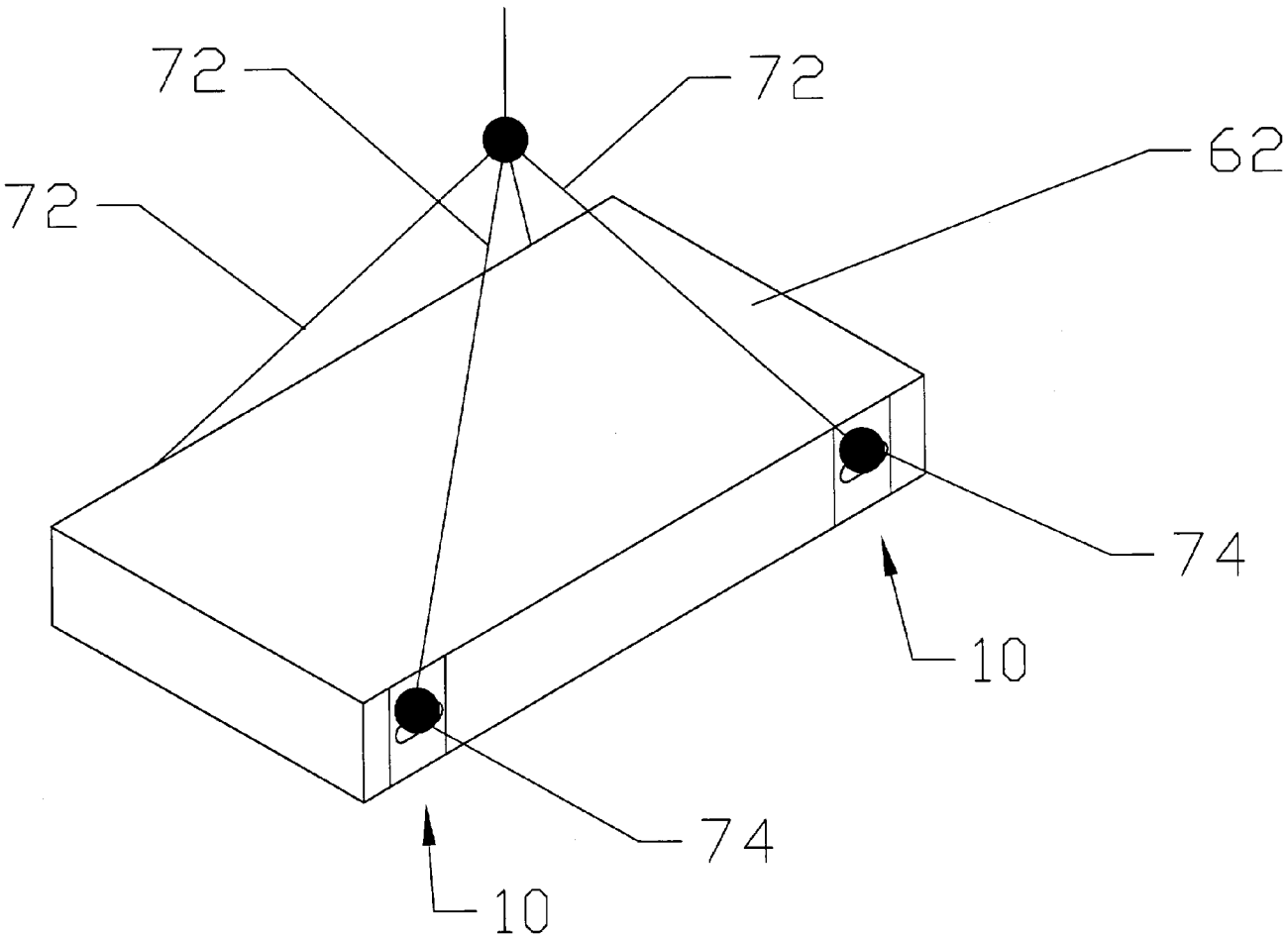
FIG. 6 shows a perspective view of a concrete wall being lifted via lifting cables attached to erection lift anchors embedded in the concrete wall.

The use of the erection lift anchor 10 and the void former 50 of the present invention is shown in particular in FIGS. 2, 5 and 6.

FIG. 2 shows the positioning of the erection lift anchor 10 in a concrete form 68. The welding plate 12 of the erection lift anchor 10 is mounted to a frame 66 which shapes the poured concrete into a desired shaped concrete form 68. The erection lift anchor 10 is positioned such that the top face 21 of the welding plate 12 is flush with the outer face 64 of the concrete form 68. Reinforcement bars 60 are passed through the reinforcement bar apertures 17 in the anchor plate 11 of the erection lift anchor 10 in order to provide more stability to the erection lift anchor 10 when the concrete hardens. The void former 50 is positioned onto the lift anchor 10 so that the top face 52 of the void former 50 is flush with the top face 21 of the welding plate 12 and the void former 50 covers the lifting attachment aperture 20 of the anchor plate 11. When concrete is poured into the frame 66 the lifting attachment aperture 20 and the other area protected by the void former 50 is free of concrete. The foot section 26 of the anchor plate 11 is shown to provide an area for insulation 70. The erection lift anchor 10 is positioned such that the top face 21 of the welding plate 21 is flush with the outer face 64 of the concrete form 68 created (i.e., it is flush with the concrete form 68 and the form side 66). When the concrete has hardened to a degree, the void former 50 can be removed from the erection lift anchor 10. The space created by the void 50 in the concrete form 68 provides a channel through access aperture 23 by which a lifting attachment (such as a hook, or other suitable attachment) can be connected to the erection lift anchor 10 via the lifting attachment aperture 20.

FIG. 5 also shows the use of the erection lift anchor 10 of the present invention to secure concrete walls 62 to each other. The erection lift anchors 10 are embedded into the concrete wall 62 in a manner as described above. The concrete walls 62 are then secured to each other by welding the top face 21 of a welding plate 12 of one erection lift anchor 10 to the top face 21 of the welding plate 12 of another erection lift anchor 10. Thus, the concrete walls 62 can securely be attached to one another.

Another aspect of the present invention is shown in FIG. 6 which shows lifting attachment hardware 74 attached to the erection lift anchor 10 of the present invention. The lifting hardware 74 is attached to cables 72. By the positioning of erection lift anchors 10 at various points in the concrete wall 62, cables 72 and lifting hardware 74 can be used to suitably position a concrete wall 62 via the use of a crane or other lifting equipment.

What is claimed is:

1. An erection lift anchor comprising:

an anchor plate having a top face, a bottom, at least one lifting attachment aperture, at least one reinforcement bar aperture, and a foot;

a welding plate formed of a single planar element having a top flat face, a bottom face, and an access aperture that passes through the top flat face and the bottom face, wherein the bottom face of the welding plate is attached to the top face of the anchor plate, and wherein the top face of the welding plate is a planar surface which is perpendicular to the anchor plate.

2. The erection lift anchor of claim 1, wherein the anchor plate further comprises a first channel, a second channel an a platform section.

3. The erection lift anchor of claim 2, wherein the platform section is positioned lower than the top of the anchor plate.

4. The erection lift anchor of claim 1, wherein the foot comprises a first proturding section, a second protruding section, a first upwardly projecting face, a second upwardly projecting face, and a foot platform.

5. The erection lift anchor of claim 4, wherein the foot platform is positioned lower than the bottom of the anchor plate.

6. An erection lift anchor kit comprising an erection lift anchor and a void former;

wherein the erection lift anchor comprises an anchor plate and a welding plate;

wherein the anchor plate has a top face, a bottom, at least one lifting attachment aperture, at least one reinforcement bar aperture, and a foot;

wherein the welding plate has a top flat face, a bottom face, and an access aperture;

wherein the bottom face of the welding plate is attached to the top face of the anchor plate, and wherein the top face of the welding plate is a planar surface which is perpendicular to the anchor plate; and wherein the void former comprises a top face, bottom face and an anchor plate channel.

7. The erection lift anchor kit of claim 6, wherein the anchor plate further comprises a first channel, a second channel an a platform section.

8. The erection lift anchor kit of claim 7, wherein the platform section is positioned lower than the top of the anchor plate.

9. The erection lift anchor kit of claim 6, wherein the foot comprises a first protruding section, a second protruding section, a first upwardly projecting face, a second upwardly projecting face, and a foot platform.

10. The erection lift anchor kit of claim 9, wherein the foot platform is positioned lower than the bottom of the anchor plate.

11. The erection lift anchor kit of claim 6, wherein the bottom face of the void former is arcuate in shape.

12. The erection lift anchor kit of claim 6, wherein the kit further comprises at least one reinforcement bar.

13. An erection lift anchor comprising an anchor plate and a welding plate:

wherein the anchor plate has a top face, a bottom, at least one lifting attachment aperture, at least one reinforcement bar aperture, a first channel, a second channel a platform section and a foot which comprises a first protruding section, a second protruding section, a first upwardly projecting face, a second upwardly projecting face, and a foot platform; and wherein the welding plate has a top flat face, a bottom face, and an access aperture, and wherein the bottom face of the welding plate is attached to the top face of the anchor plate, and wherein the top face of the welding plate is a planar surface which is perpendicular to the anchor plate.

14. The erection lift anchor of claim 13, wherein the platform section is positioned lower than the top of the anchor plate.

15. The erection lift anchor of claim 13, wherein the foot platform is positioned lower than the bottom of the anchor plate.

16. An erection lift anchor kit comprising an erection lift anchor and a void former;

wherein the erection lift anchor comprises an anchor plate and a welding plate;

wherein the anchor plate has a top face, a bottom, at least one lifting attachment aperture, at least one reinforcement bar aperture, a first channel, a second channel a platform section and a foot which comprises a first protruding section, a second protruding section, a first upwardly projecting face, a second upwardly projecting face, and a foot platform;

wherein the welding plate has a top flat face, a bottom face, and an access aperture;

wherein the bottom face of the welding plate is attached to the top face of the anchor plate, and wherein the top face of the welding plate is a planar surface which is perpendicular to the anchor plate; and wherein the void former comprises a top face, an arcuate bottom face and an anchor plate channel.

17. The erection lift anchor kit of claim 16, wherein the platform section is positioned lower than the top of the anchor plate.

18. The erection lift anchor kit of claim 16, wherein the foot platform is positioned lower than the bottom of the anchor plate.

19. A method of securing concrete members to each other comprising:

positioning a first void former having a top face and a bottom face and an anchor plate channel on a first erection lift anchor comprising an anchor plate and a welding plate; wherein the anchor plate has a top, a bottom, a lifting attachment aperture, reinforcement bar apertures, and a foot; the welding plate has a top face, a bottom face, and an ac&ess aperture; wherein the bottom face of the welding plate is attached to the top of the anchor plate; and wherein the anchor plate channel of the first void former receives the anchor plate of the first erection lift anchor and covers the lifting attachment aperture of the first erection lift anchor, to form a first void former/anchor system;

embedding the first void former/anchor system in a first concrete member having an outer face, such that the top face of the first erection lift anchor is flush with the outer face of the first concrete member;

removing the first void former from the first erection lift anchor;

positioning a second void former having a top face and a bottom face and an anchor plate channel on a second erection lift anchor comprising an anchor plate and a welding plate; wherein the anchor plate has a top, a bottom, a lifting attachment aperture, reinforcement bar apertures, and a foot; the welding plate has a top face, a bottom face, and an access aperture; wherein the bottom face of the welding plate is attached to the top of the anchor plate; and wherein the anchor plate channel of the second void former receives the anchor plate of the second erection lift anchor and covers the lifting attachment aperture of the second erection lift anchor, to form a second void former/anchor system;

embedding the second void former/anchor system in a second concrete member having an outer face, such that the top face of the second erection lift anchor is flush with the outer face of the second concrete member;

removing the second void former from the second erection lift anchor;

securing the first concrete member to the second concrete member by welding the welding plate of the first erection anchor lift to the welding plate of the second erection anchor lift.

20. The method of claim 19, wherein the anchor plate of the first erection lift anchor further comprises a first channel, a second channel an a platform section; and wherein the anchor plate of the second erection lift anchor further comprises a first channel, a second channel an a platform section.

21. The method of claim 19, wherein the wherein the foot of the first erection anchor lift comprises a first protruding section, a second protruding section, a first upwardly projecting face, a second upwardly projecting face, and a foot platform; and wherein the foot of the second erection anchor lift comprises a first protruding section, a second protruding section, a first upwardly projecting face, a second upwardly projecting face, and a foot platform.

* * * * *